US007036623B2

(12) United States Patent
Hilvers et al.

(10) Patent No.: US 7,036,623 B2
(45) Date of Patent: May 2, 2006

(54) CONTROL CONFIGURATION FOR A UTILITY VEHICLE HAVING, E.G., AN EXTENDABLE UTILITY BOOM

(75) Inventors: Michael J. Hilvers, Fort Jennings, OH (US); John A. Garberson, Columbus Grove, OH (US)

(73) Assignee: Unverferth Manufacturing Company, Inc., Kalida, OH (US)

( * ) Notice: Subject to any disclaimer, the term of this patent is extended or adjusted under 35 U.S.C. 154(b) by 114 days.

(21) Appl. No.: 10/386,525

(22) Filed: Mar. 13, 2003

(65) Prior Publication Data

US 2003/0173135 A1 Sep. 18, 2003

Related U.S. Application Data

(60) Provisional application No. 60/364,022, filed on Mar. 15, 2002.

(51) Int. Cl.
*B60K 26/00* (2006.01)

(52) U.S. Cl. ..... 180/315; 180/333; 74/469; 74/471

(58) Field of Classification Search ..... 180/315, 180/333; 74/469, 471, 473.16, 473.17, 473.19
See application file for complete search history.

(56) References Cited

U.S. PATENT DOCUMENTS 3,858,675 A * 1/1975 Geis ..... 180/307
4,014,220 A * 3/1977 Feigel ..... 74/522
4,398,861 A * 8/1983 Shimoie ..... 414/694
4,869,337 A * 9/1989 Wagner ..... 180/330
5,056,985 A * 10/1991 Johnson et al. ..... 414/694
5,197,347 A * 3/1993 Moffitt et al. ..... 74/481
5,232,057 A * 8/1993 Renard ..... 172/812
5,467,663 A * 11/1995 Trowbridge ..... 74/481
5,553,992 A * 9/1996 Ashcroft ..... 414/685
5,918,694 A * 7/1999 Miller et al. ..... 180/89.14
6,131,062 A * 10/2000 Nielsen ..... 701/50
6,526,846 B1 * 3/2003 Duppong et al. ..... 74/564
6,581,704 B1 * 6/2003 Law et al. ..... 180/6.32

* cited by examiner

*Primary Examiner*—Paul N. Dickson
*Assistant Examiner*—Toan C. To
(74) *Attorney, Agent, or Firm*—Rockwell, Figg, Ernst & Manbeck

(57) ABSTRACT

In preferred embodiments, a utility vehicle (such as, e.g., a skid steer vehicle) has a multitude of potential control-to-function configurations (in some preferred embodiments, enabling about sixteen or more configurations). The control-to-function configurations can preferably be selected by matching different control elements to different function drive elements. Preferably, the control elements (such as, e.g., hand control elements and foot control elements) have similar attachment mechanisms and the function drive elements (such as, e.g., various powered devices) have similar attachment mechanisms, whereby multiple control-to-function configurations can be readily achieved.

22 Claims, 15 Drawing Sheets

CONTROL CONFIGURATION FOR A UTILITY VEHICLE HAVING, E.G., AN EXTENDABLE UTILITY BOOM

BACKGROUND

The present application claims priority to Provisional Patent Application Ser. No. 60/364,022, filed on Mar. 15, 2002, the entire disclosure of which is incorporated herein by reference.

1. Field of the Invention

The present invention relates generally to, among other things, utility vehicles such as, for example, skid steer vehicles having extendable utility booms and/or other mechanisms.

2. Discussion of the Background

There are a variety of known utility vehicles having extendable utility booms and/or other mechanisms. These utility vehicles are often used for construction and/or other utilitarian purposes, such as, e.g., for lifting, pushing, scraping, digging, plowing and/or various other purposes. In many instances, the vehicles include a) a main body having at least one seat for a vehicle operator (such as, for example, a seat located within a protective cab), b) wheels and/or other supports mounted on the body portion for supporting the same, and c) a utility mechanism mounted to the vehicle (such as, e.g., via a utility boom). In some illustrative cases, the utility mechanism(s) can include, e.g., one or more of the following: a) an auger; b) a backhoe; c) a dozer blade; e) a bucket; f) a fork (e.g., for pallets, manure or the like); g) a grinder; h) a rake; i) shears; j) a roller; k) spike (e.g., for bails of hay or the like); l) a jig boom; m) a broom; n) a scraper; o) a tree spade; p) a plow; q) a mower; r) a trencher; s) a four-in-one bucket; and/or various other utility mechanisms. In some instances, the vehicle is adapted such that various utility mechanisms can be replaced, interchanged, upgraded and/or the like. In this manner, a basic vehicle can be adapted or configured to perform specific tasks (such as, e.g., by attaching a new utility mechanism to the vehicle).

Because these vehicles are often used for work related purposes, ease-of-adaptability and/or configurability can be advantageous (such as, e.g., to enable full use of equipment, to save time, to enhance functionality and/or various other possible advantages). Nevertheless, existing devices have limitations making configuration of the device to match a user's needs and/or for other purposes more difficult.

There remains a need for, among other things, vehicles having improved configurability, such as, e.g., improved control configurability to achieve a desired purpose or result.

SUMMARY OF THE PREFERRED EMBODIMENTS

The preferred embodiments of the present invention can significantly improve upon existing systems and methods. In some preferred embodiments, a utility vehicle is provided that facilitates configurability of control mechanisms.

In some preferred embodiments of the invention, control structures for a vehicle can enable a multitude of control-to-function configurations. In the most preferred embodiments, a multitude of configurations can be established between a) a plurality of control elements and b) a plurality of vehicle functions that can be controlled via the control elements. In the most preferred embodiments, the plurality of control elements include at least four control elements. In the most preferred embodiments, the plurality of vehicle functions include at least four vehicle functions.

In some illustrative embodiments, a skid steer utility vehicle having an extendable boom is provided that includes: a vehicle body; an engine supported by the vehicle body; an extendable boom supported by the body; a utility mechanism supported by the boom; a plurality of controlled devices, each of the controlled devices affecting a respective vehicle function, and each of the controlled devices being driven by a similarly configured drive mechanism; a plurality of user operated control elements, each of the user operator control elements having a similarly configured control attachment mechanism; and each the control attachment mechanism being connectable with each the drive attachment mechanism to provide a multitude of control-to-function configurations. In some preferred embodiments, the control elements include a plurality of hand controls and a plurality of foot controls. In some preferred embodiments, the multitude of control-to-function configurations includes at least sixteen selectable configurations.

In some illustrative embodiments, a utility vehicle having at least one utility mechanism is provided that includes: a vehicle body; an engine supported by the vehicle body; at least one utility mechanism supported by the vehicle body; at least four controlled devices, each of the controlled devices affecting a respective vehicle function, and each of the controlled devices being driven by a similarly configured drive mechanism; at least four user operated control elements, each of the user operator control elements having a similarly configured control attachment mechanism; and each the control attachment mechanism being connectable with each the drive attachment mechanism to provide at least sixteen control-to-function configurations. In preferred embodiments, the control elements include a plurality of hand operated control arms and a plurality of foot operated control pedals. In some preferred embodiments, each the control attachment mechanism includes a control lever and each the drive attachment mechanism includes a cable.

In some illustrative embodiments, a method for selecting a control-to-function configuration for a utility vehicle having at least one utility mechanism is performed that includes: a) providing a utility vehicle having a vehicle body, an engine supported by the vehicle body, at least one utility mechanism supported by the vehicle body, at least four controlled devices, each of the controlled devices affecting a respective vehicle function, and each of the controlled devices being driven by a similarly configured drive mechanism, at least four user operated control elements, each of the user operator control elements having a similarly configured control attachment mechanism, and each the control attachment mechanism being connectable with each the drive attachment mechanism to provide at least sixteen control-to-function configurations; and b) connecting the control attachment mechanisms to the drive attachment mechanisms in accordance with a desired control-to-function configuration.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The accompanying figures, in which similar reference numerals show similar elements, are provided by way of example, without limiting the broad scope of the invention or various other embodiments, wherein.

DETAILED DESCRIPTION OF THE PREFERRED EMBODIMENTS

While the present invention may be embodied in many different forms, a number of illustrative embodiments are described herein with the understanding that the present disclosure is to be considered as providing examples of the principles of the invention and that such examples are not intended to limit the invention to preferred embodiments described herein and/or illustrated herein.

The preferred embodiments of the invention include novel control mechanisms implemented within a utility vehicle. In various embodiments, the novel control mechanisms can be implemented within any appropriate vehicle structure. For example, various control elements can be implemented within various utility vehicles, such as various utility vehicles having extendable booms, utility mechanisms and/or the like. The following section describes some non-limiting examples of illustrative vehicles in which some embodiments of the present invention can be implemented. It should be appreciated that these examples are provided by way of illustration only.

Illustrative Vehicle Structures:

The preferred embodiments of the invention can be implemented within a variety of vehicles, such as, for example, within vehicles having a raised and/or lowered utility booms, such as, e.g., various skid steer loaders. While preferred embodiments described herein show skid steer loaders, it should be appreciated that the various embodiments may be employed within any appropriate vehicle type. Additionally, while some preferred embodiments have a bucket utility accessory connected to the boom, it should be appreciated that the various embodiments may employ any other appropriate utility mechanism, such as, for example, any of utility mechanism discussed herein and/or otherwise known in the art.

Figure 1A:
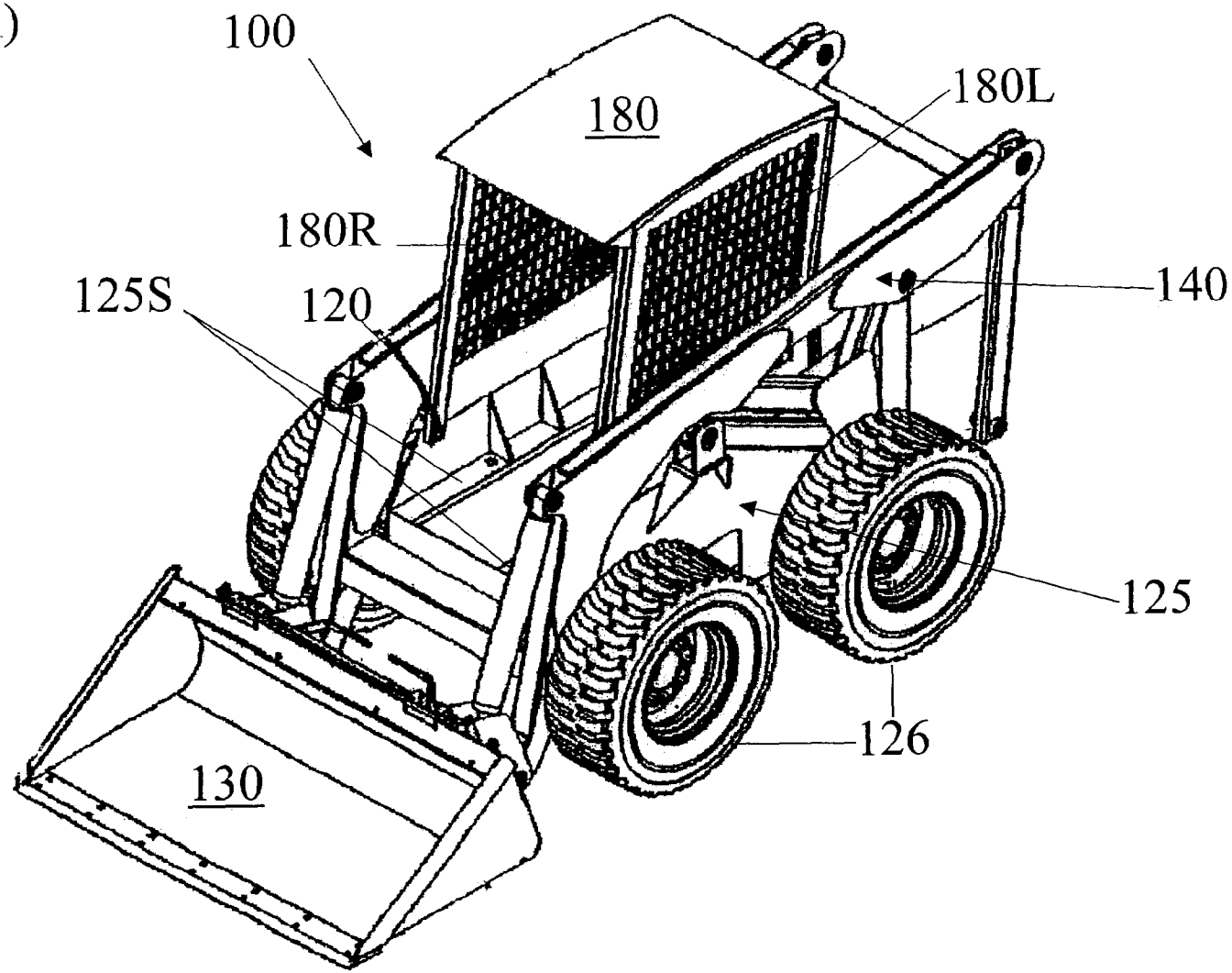
FIG. 1(A) is a front left perspective view of a skid steer vehicle with a boom in a lowered position according to some illustrative embodiments of the invention.
Figure 1B:
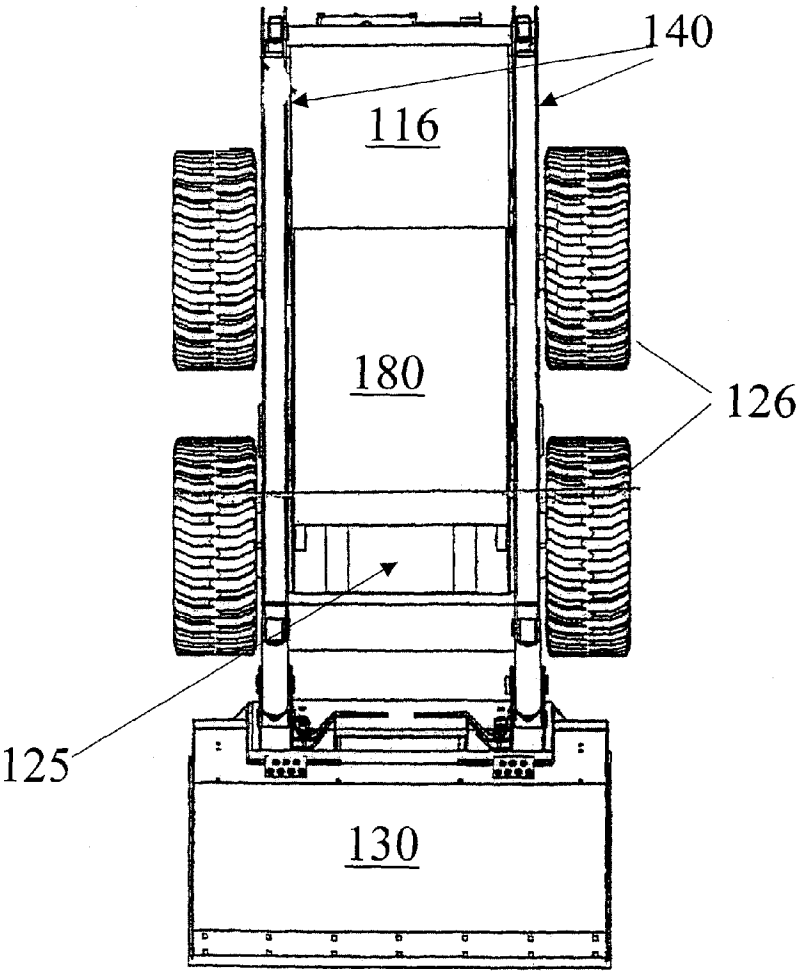
FIG. 1(B) is a top view of the skid steer vehicle shown in FIG. 1(A)
Figure 1C:
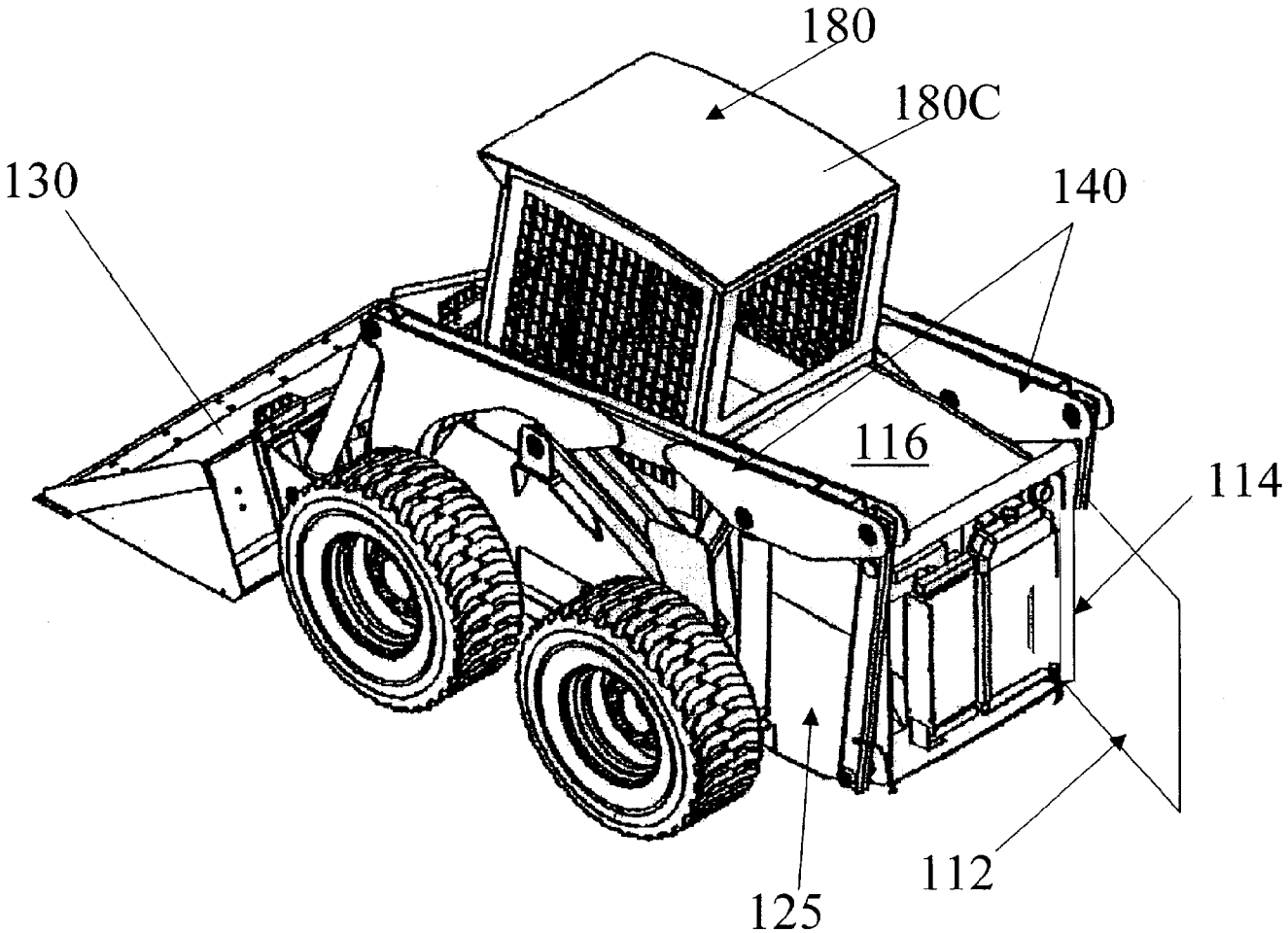
FIG. 1(C) is a rear left perspective view of a skid steer vehicle shown in FIG. 1(A)
Figure 1D:
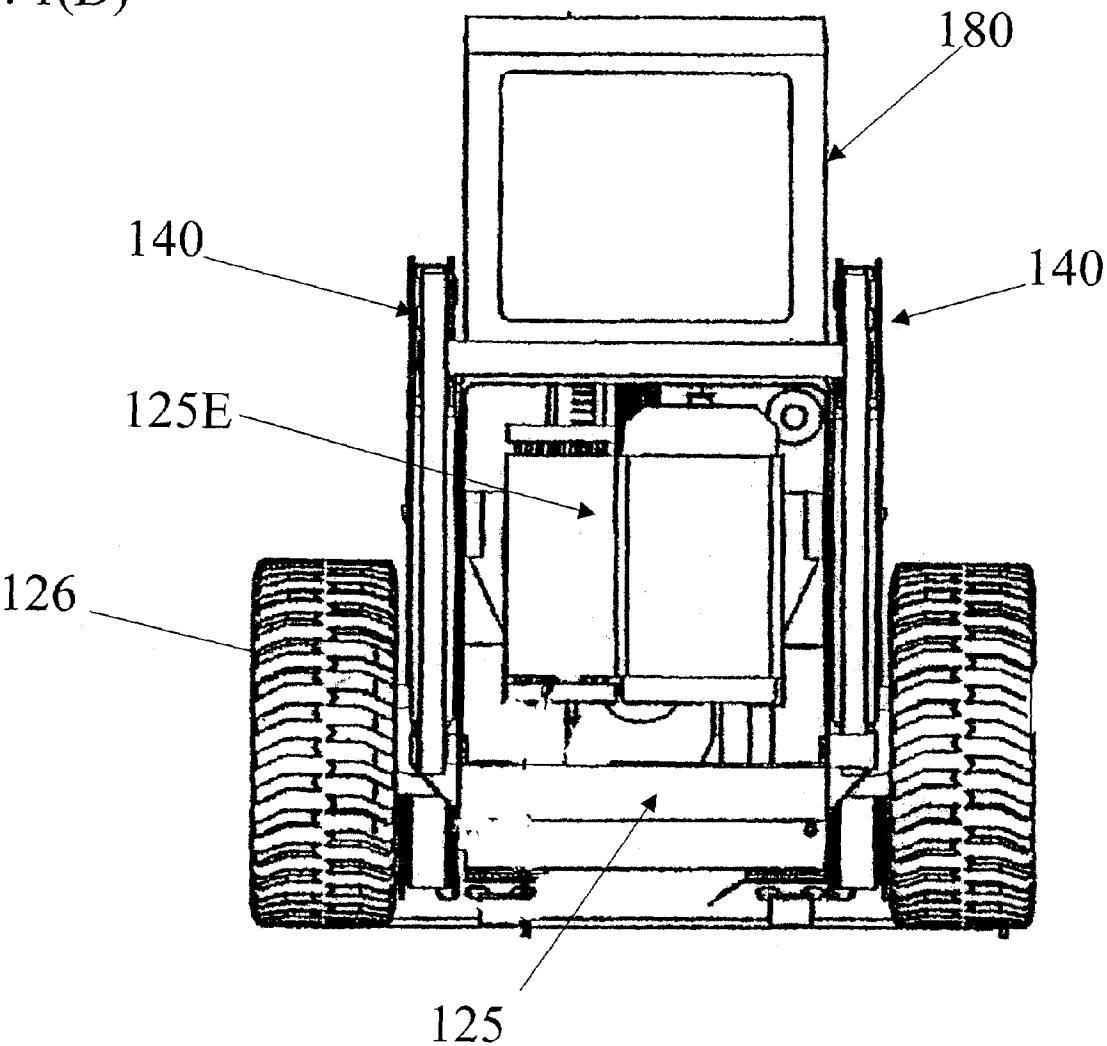
FIG. 1(D) is a rear view of the skid steer vehicle shown in FIG. 1(A)

FIGS. 1(A)–3 show illustrative vehicles in which some preferred embodiments of the invention can be implemented. In this regard, FIGS. 1(A)–1(F) show an illustrative embodiment of a skid steer vehicle with a boom in a lowered position. Specifically, FIG. 1(A) shows a front left perspective view of an illustrative skid steer vehicle, FIG. 1(B) shows a top view of the skid the vehicle, FIG. 1(C) shows a rear left perspective view of the vehicle, FIG. 1(D) shows a rear view of the vehicle, FIG. 1(E) shows a left view of the vehicle and FIG. 1(F) shows a front view of the vehicle.

As illustrated, the vehicle 100 preferably includes a main body 125. In the illustrated embodiment, the main body 125 is movably supported via a plurality of wheels 126. While the illustrated embodiments include four wheels, other embodiments can include any other number of wheels and/or can include other support mechanisms such as belts, stabilizers and/or the like. As mentioned above, while the wheels 126 can provide skid steering, other embodiments could include or use other forms of steering.

Figure 3:
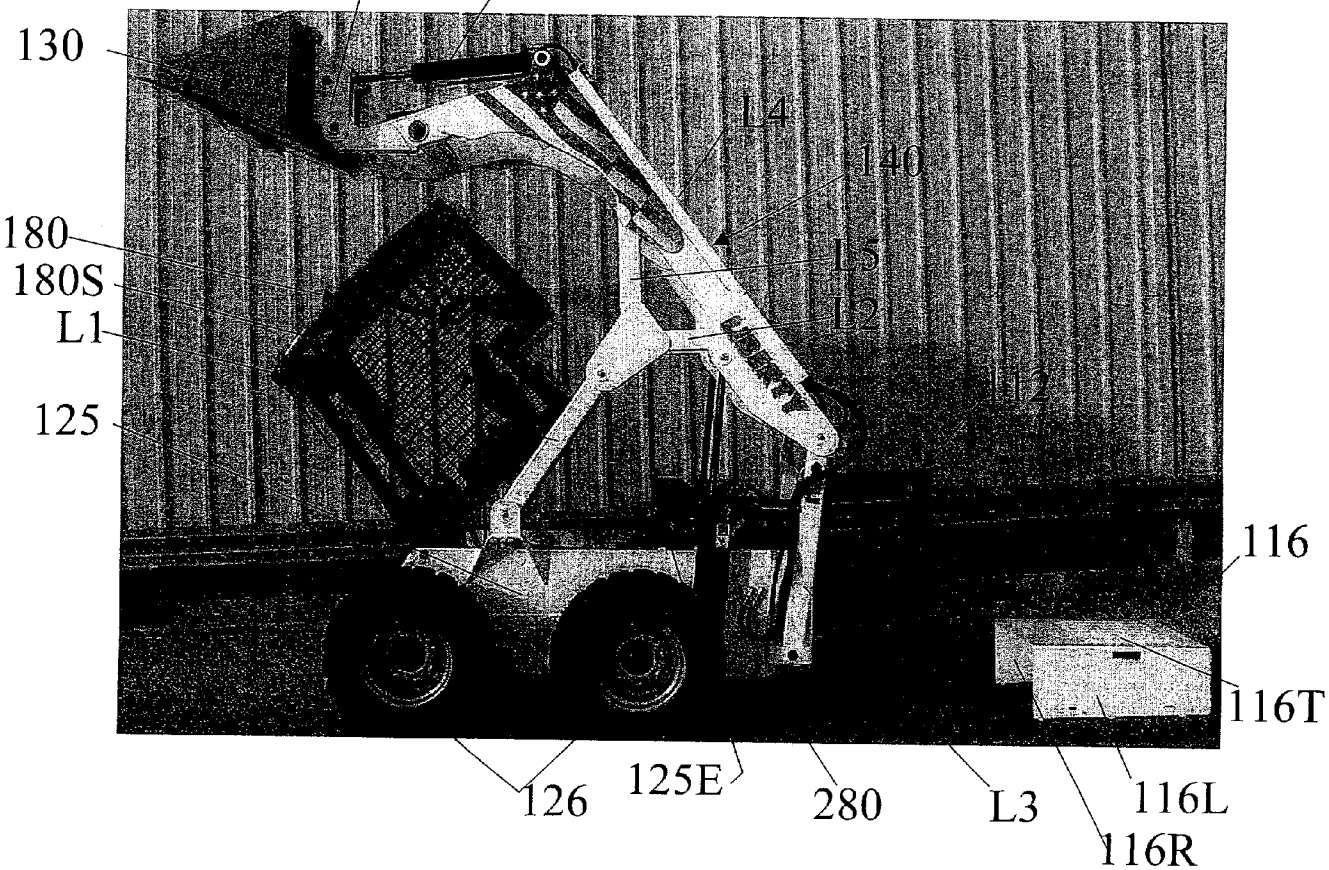
FIG. 3 is a side view of a skid steer vehicle according to some illustrative embodiments.

In some preferred embodiments, the vehicle 100 includes an operator cab 180 having at least one seat 180S, such as, e.g., shown in FIG. 3, fixedly mounted therein. For example, the cab can include, in some embodiments, an integral floor or seat mount (not shown) and the seat 180S can be mounted upon the floor or seat mount. In preferred embodiments, the cab 180 includes left and/or right protective side walls 180L and/or 180R (such as, e.g., including a lattice or grid-work of metal bars as shown) and/or a protective cover 180C. Preferably, the cab 180 is mounted via a mechanism that enables the cab to move towards a front of the vehicle for maintenance purposes. In that regard, the cab 180 is preferably mounted so as to pivot towards a front of the vehicle. The cab 180 is preferably mounted so as to pivot with respect to the body 125 via a hinge 120 located proximate a front side of the cab. The hinge 120 can include, e.g., one or more pivot mechanism between the body 125 and the cab 180 (such as, e.g., on left and/or right sides of the cab 180). In this manner, the cab 180 can preferably be pivoted forward to a maintenance and/or service position, such as, e.g., shown in FIG. 3. In some preferred embodiments, this structure enables access to engine and/or drive systems supported upon the body at a location, at least partly, otherwise obstructed by the cab 180, such as, e.g., at least partly below the cab during normal operation of the vehicle.

In some preferred embodiments, to enhance maintenance and/or service ability, a rear-end access feature is provided. Preferably, the rear-end access feature enables substantially unobstructed access by a maintenance and/or service operator from a rear-end of the vehicle. In some preferred embodiments, the rear end of the vehicle is accessible during maintenance and/or service via a door 112 providing access through a rear end of the vehicle body. In some preferred embodiments, the door 112 can be pivoted open. Preferably, the door can be pivoted around a generally vertical pivot to facilitate access. In illustrative embodiments, access to engine and/or drive systems (such as, e.g., motor parts) can be provided through a rear door 112 having a hinge 114 at a right rear corner of the body 125, as shown in FIG. 3. In that regard, FIG. 3 shows door 112 in the open position. Preferably, the door 112 extends across substantially the entire width of rear-end of the vehicle body 125, from a left side to a right side of the vehicle body 125. In addition, the door 112 preferably extends across substantially the entire height of the rear-end of the vehicle body 125, from a bottom to a top of the vehicle body 125. In this manner, when the door is open, a maintenance and/or service operator can readily stand to the rear of the vehicle and have substantially full access therein.

Figure 1E:
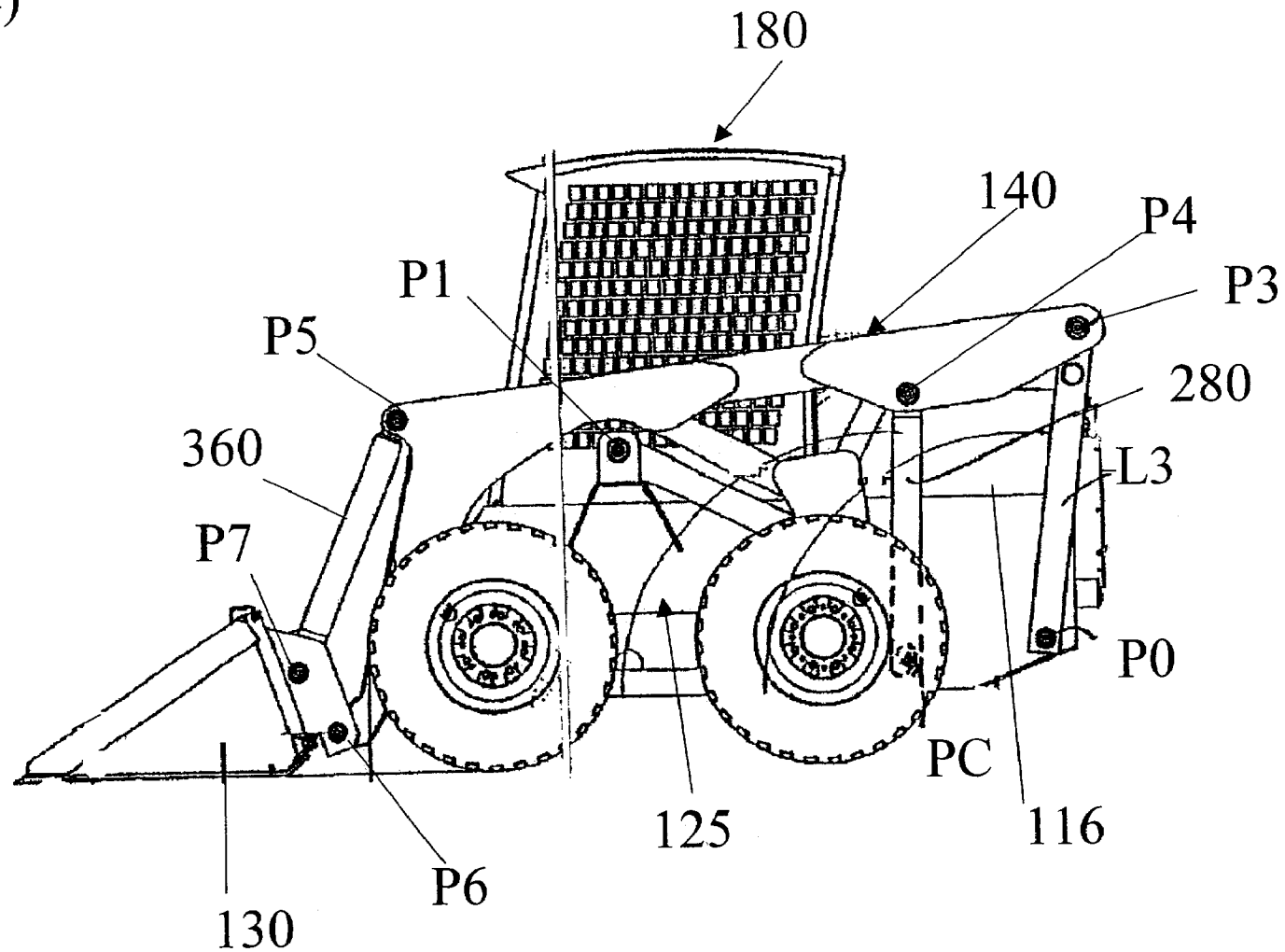
FIG. 1(E) is a left view of the skid steer vehicle shown in FIG. 1(A)
Figure 1F:
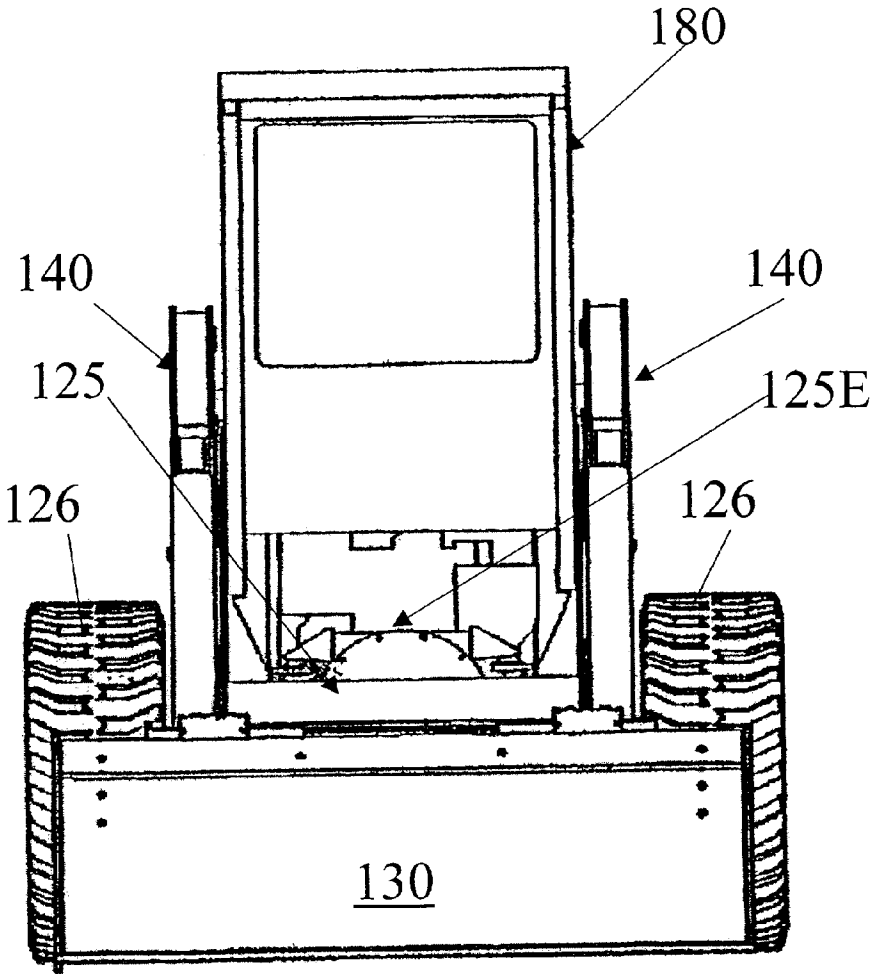
FIG. 1(F) is a front view of the skid steer vehicle shown in FIG. 1(A)

In some preferred embodiments, the body 125 extends further rearward than the cab 180, such as, e.g., shown in FIGS. 1(E). In the preferred embodiments, a cover 160 is preferably provided that covers an interior of the body (such as, e.g., covering engine and/or drive systems and/or the like). Preferably, the cover 116 includes a top wall 116T, a left wall 116L and/or a right wall 116R. In this manner, in order to provide further access to the interior of the body 125, the cover 116 can be removed. In some embodiments, the cover can be fully removed and separated from the vehicle, such as shown in FIG. 3.

In some preferred embodiments, a boom 140 is provided that is preferably configured in a manner to enable substantially unobstructed left and/or right side access into the vehicle body. In preferred embodiments, a boom 140 is provided that can be located in lowered position (such as, e.g., shown in FIGS. 1(A)–1(F)) and/or in a raised position (such as, e.g., shown in FIGS. 2(A)–2(F)). In preferred embodiments, a boom linkage is provided that is in a retracted state when the boom is in the lowered position and in an expanded state when the boom is in the raised position.

Figure 2A:
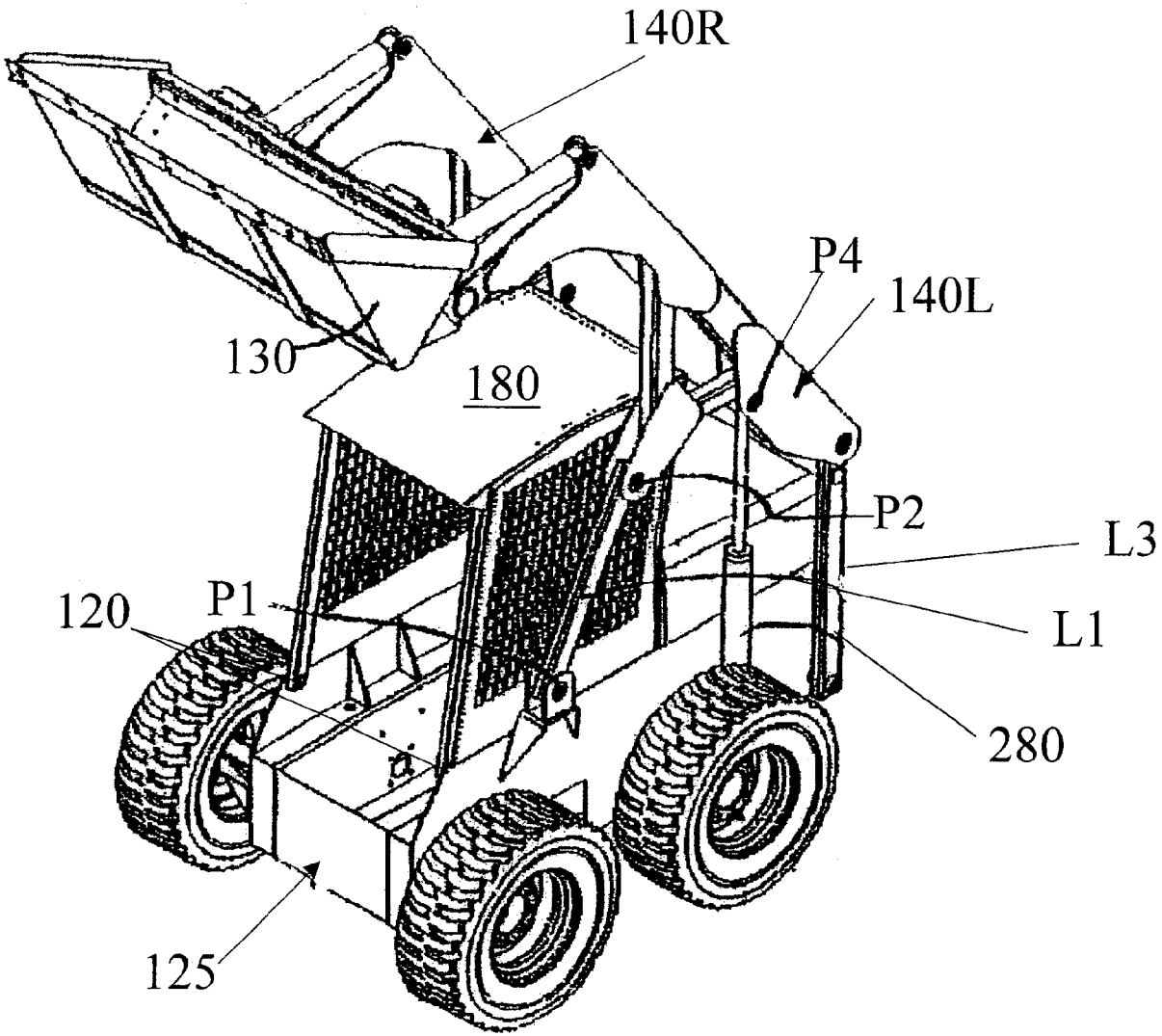
FIG. 2(A) is a front left perspective view of a skid steer vehicle with a boom in a raised position according to some illustrative embodiments of the invention.
Figure 2B:
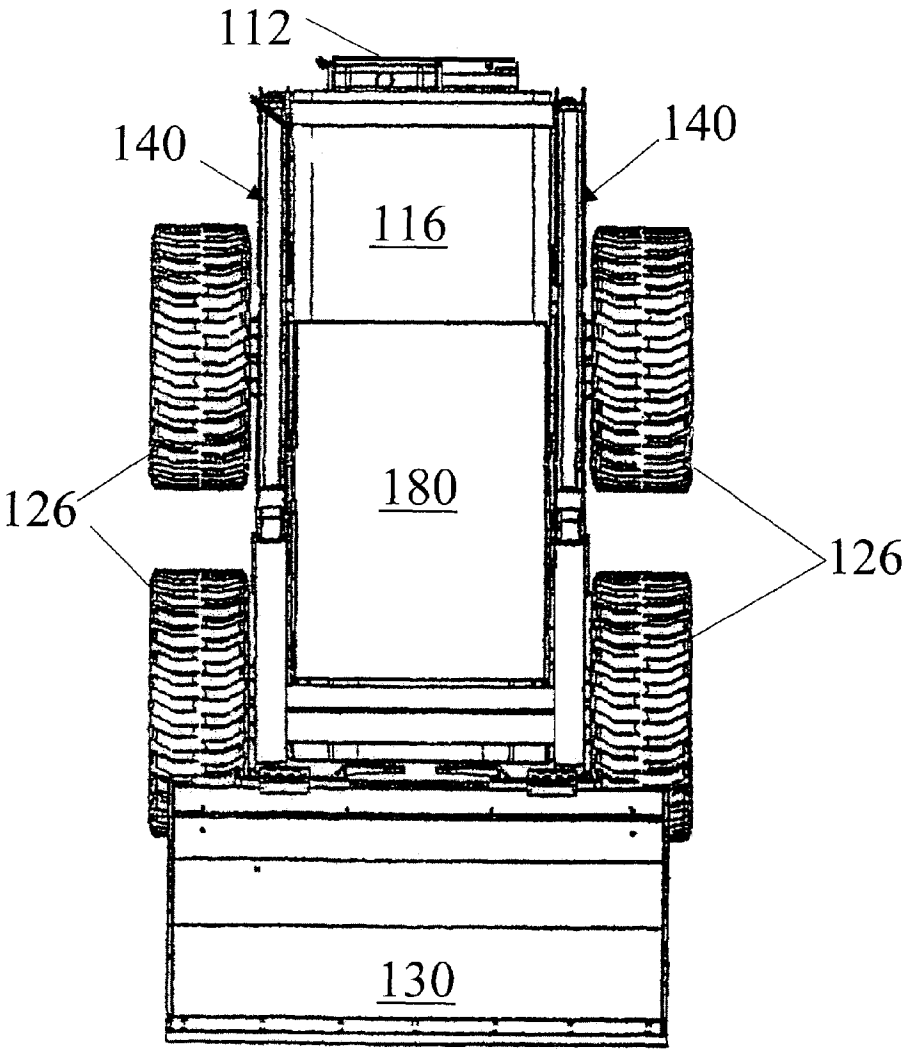
FIG. 2(B) is a top view of the skid steer vehicle shown in FIG. 2(A)
Figure 2C:
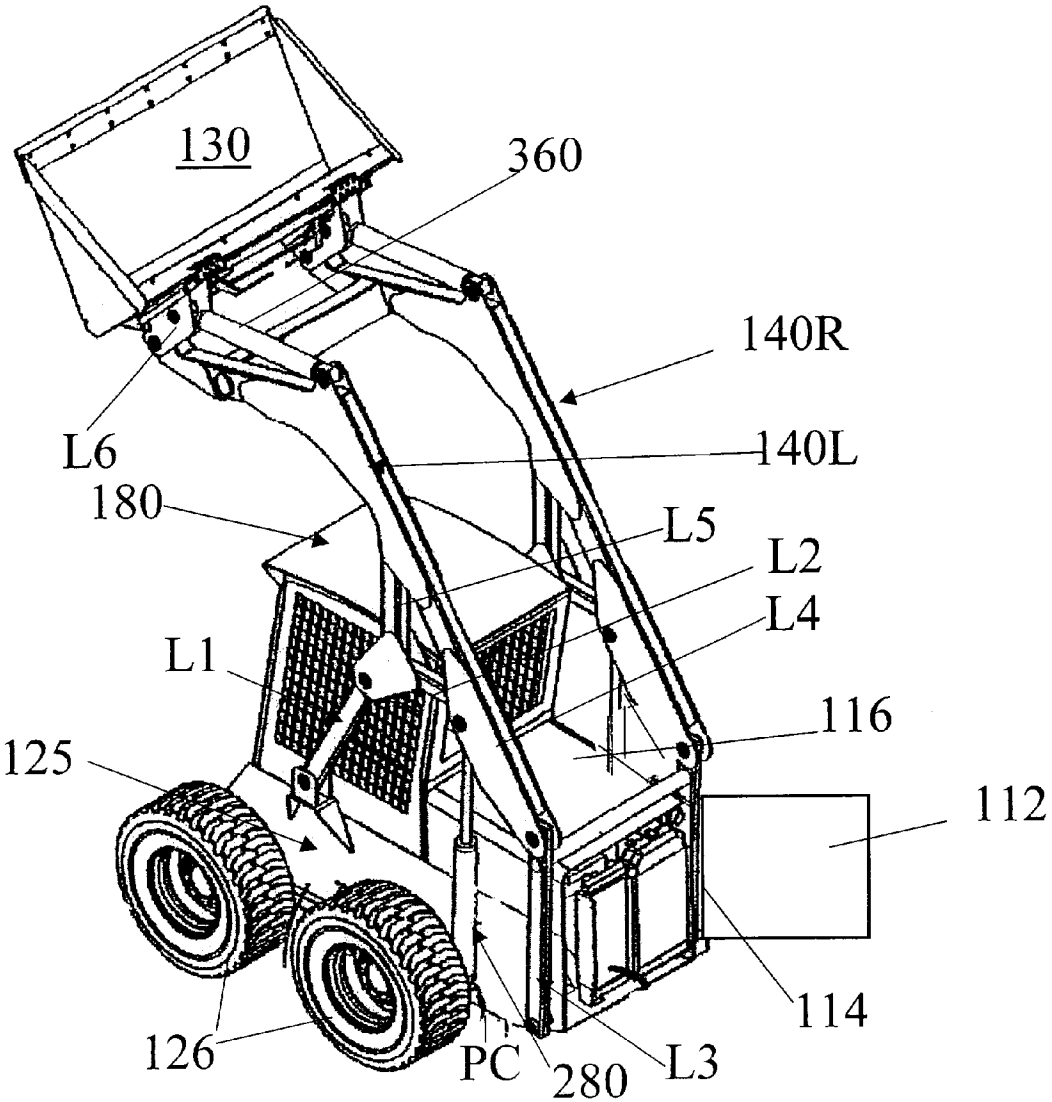
FIG. 2(C) is a rear left perspective view of a skid steer vehicle shown in FIG. 2(A)
Figure 2D:
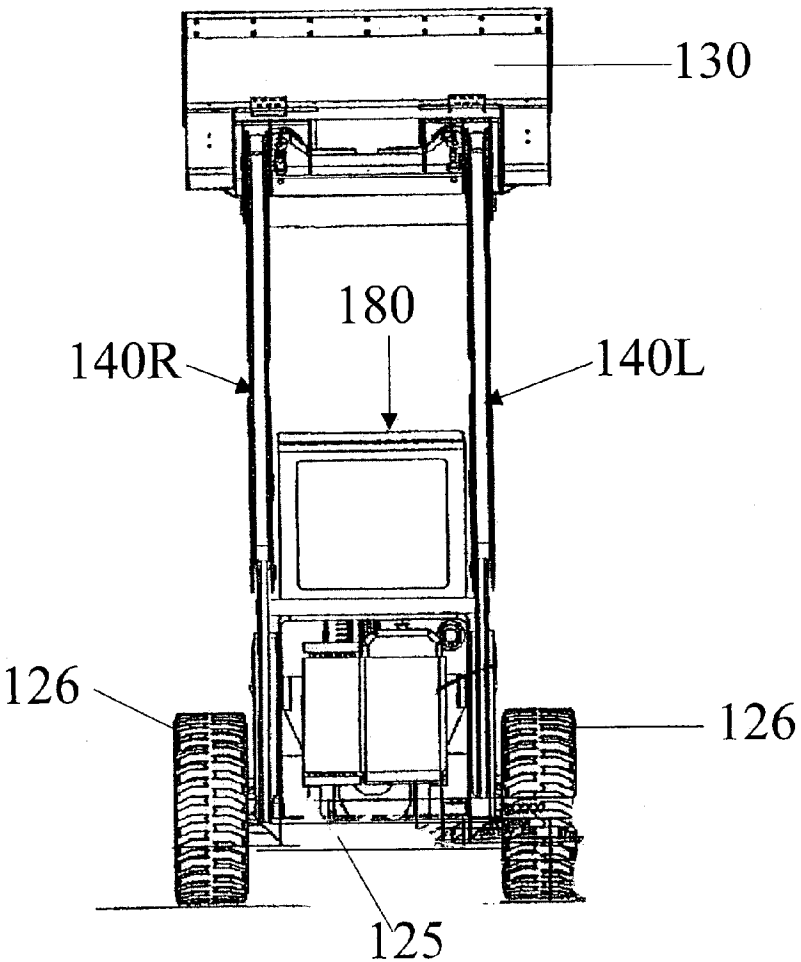
FIG. 2(D) is a rear view of the skid steer vehicle shown in FIG. 2(A)
Figure 2E:
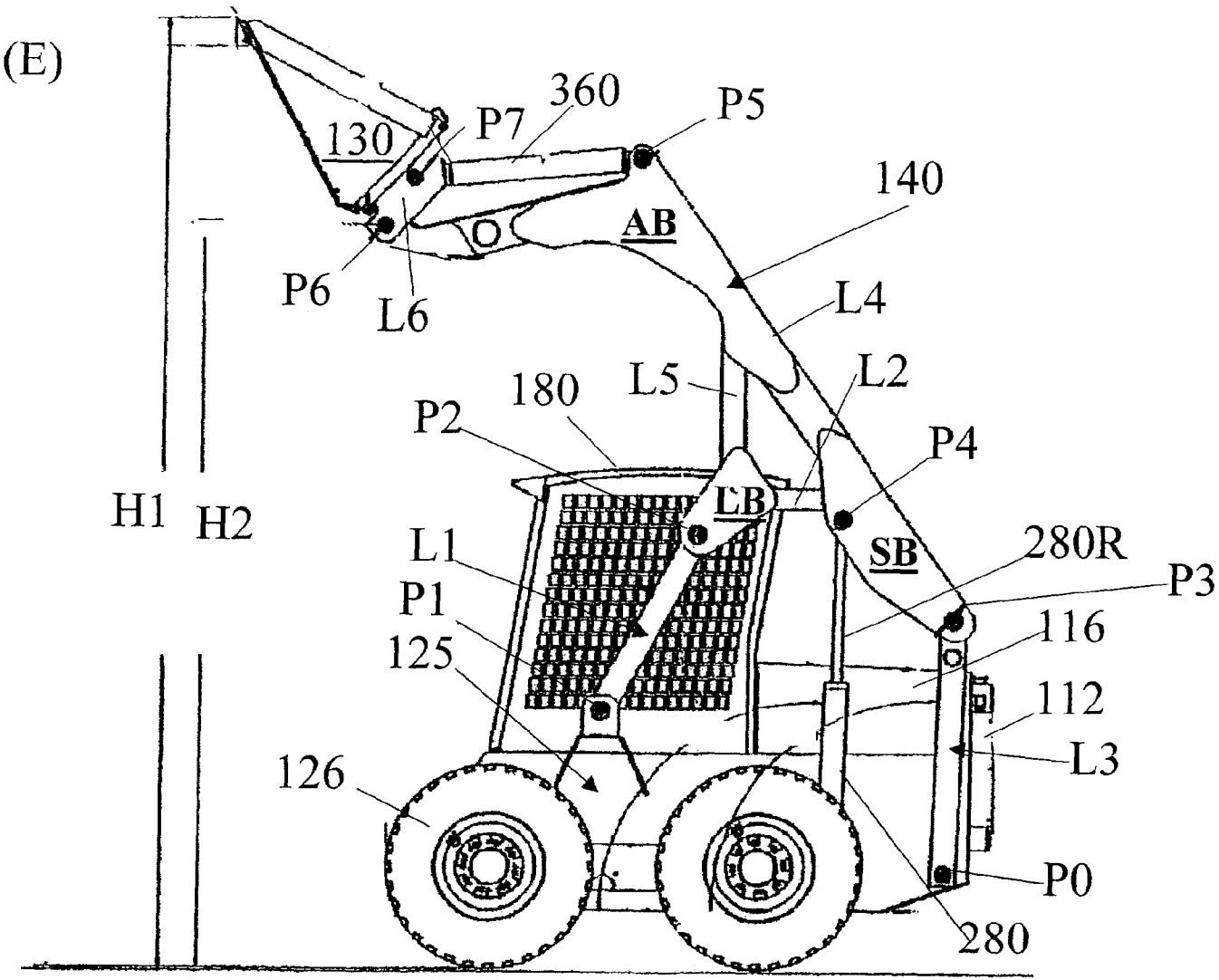
FIG. 2(E) is a left view of the skid steer vehicle shown in FIG. 2(A)
Figure 2F:
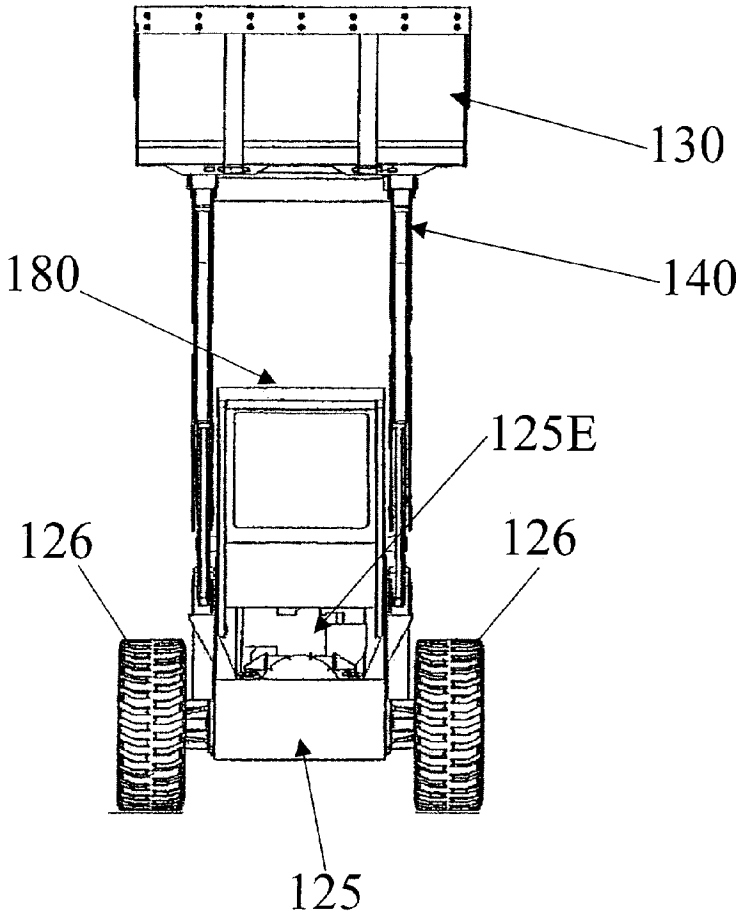
FIG. 2(F) is a front view of the skid steer vehicle shown in FIG. 2(A)

In some illustrative and non-limiting embodiments, the boom includes respective boom assemblies 140L and 140R on left and right sides of the vehicle 100, respectively. Preferably, the boom assemblies include a front link L1 that is pivotally connected at a pivot P1 and a rear link L3 that is pivotally connected to the rear of the boom assembly 140 at rear boom pivot P3. The rear link L3 is preferably connected to vehicle 100 by a rear mount P0. As shown in FIG. 2(E), the boom preferably includes a utility mechanism mounted thereon, such as in some illustrative examples, a bucket as shown. In that regard, a bucket 130 is preferably connected to the boom 140 via a pivot P6 and is preferably raised and lowered by at least one hydraulic cylinder 360 connected to bucket 130 via a pivot P7. In addition, the hydraulic cylinder 360 is preferably connected to the boom 140 at a pivot P5.

In some preferred embodiments, the boom can include links L1–L6 substantially as illustrated. In that regard, the link L1 is preferably pivotally attached to the body 125 at a pivot P1 and is pivotally attached to a bracket LB at a pivot P2. In some embodiments, the link L3 can be pivotally attached to the body 125, such as, e.g., at a pivot P0. In some embodiments, the link L3 can be fixedly attached to the body 125 so as to extend generally upright therefrom. In some embodiments, the link L4 can be pivotally attached to the link L3 at a location above the top of the body 125, such as, e.g., as shown. Preferably, the link L4 is an elongated member that extends from the link L3 to a top of the boom. In the illustrated embodiment, the link L4 is generally L-shaped and includes a cylinder 360 connected between a pivot P5 on the link L4 and a pivot P7 on the link L6. In some embodiments, a utility mechanism, such as, e.g., a bucket 130, as shown, can be connected to the link L6 and pivotally attached to the link L4 via a pivot P6. Preferably, the link L4 includes a top angle bracket AB and/or a bottom support bracket SB to facilitate pivotal mounting and for enhanced strength and durability. In some embodiments, the links L2 and/or L5 can be pivotally connected to the link L4 (such as, e.g., via brackets AB and/or SB) and/or pivotally connected to the bracket LB. In some embodiments, the links L2 and/or L5 can be fixedly connected to the link L4 (such as, e.g., via brackets AB and/or SB) and/or fixedly connected to the bracket LB. In some embodiments, the links L2 and/or L5 can be unitarily formed with the link L4.

In some embodiments, the boom can be raised and/or lowered via at least one cylinder 280. In some preferred embodiments, the cylinder 280 is an hydraulically powered cylinder with an extendable cylinder rod 280R. A base end of the cylinder is preferably pivotally attached to the body 125, while a distal end of the cylinder rod is preferably pivotally attached to the link L4.

In some illustrative embodiments, the cylinder 280 is hydraulically operated and is connected to the boom 140 at pivot P4. As shown in FIG. 2(C), the boom cylinder 280 is also preferably connected to the vehicle 100 at the pivot PC, such as shown in phantom lines in FIG. 1(E).

In some preferred embodiments, the boom is configured so that in a raised position (such as, e.g., shown in FIGS. 2(A)–2(F) and/or FIG. 3) the top of the bucket 130 is at a height H1 of about 125 to 175 inches (in one example, about 150 inches) and the bottom of the bucket 130 is at a height H2 of about 100 to 130 inches (in one example, about 115 inches). In some preferred embodiments, the structure of the vehicle can be sized and configured with dimensions substantially as shown in FIGS. 1(A) to 2(F) and/or FIG. 3, with such figures being substantially proportional and to scale in some illustrative and non-limiting embodiments of the invention.

Figure 4:
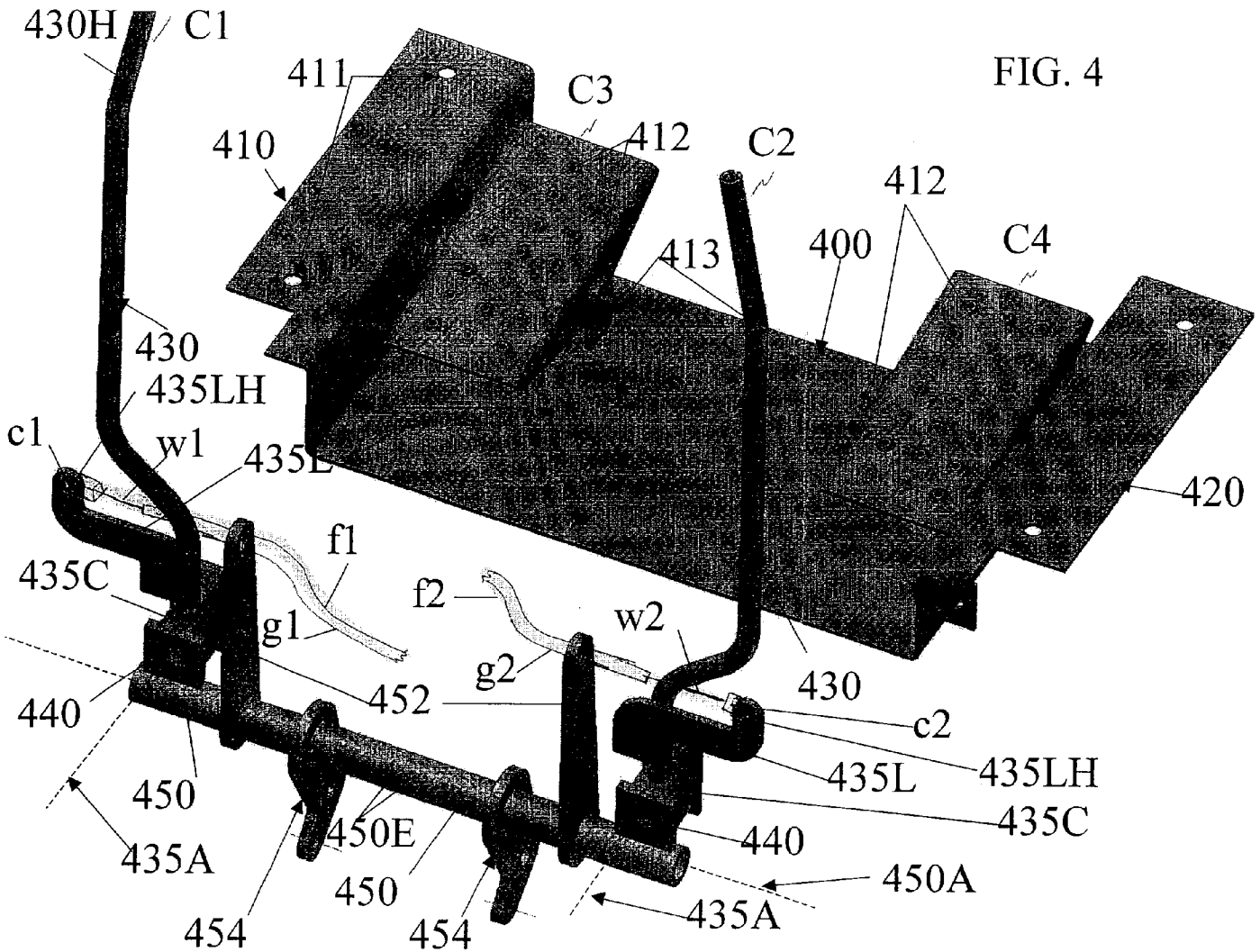
FIG. 4 is a rear top perspective view of some control mechanism components in some illustrative preferred embodiments of the invention.
Figure 5:
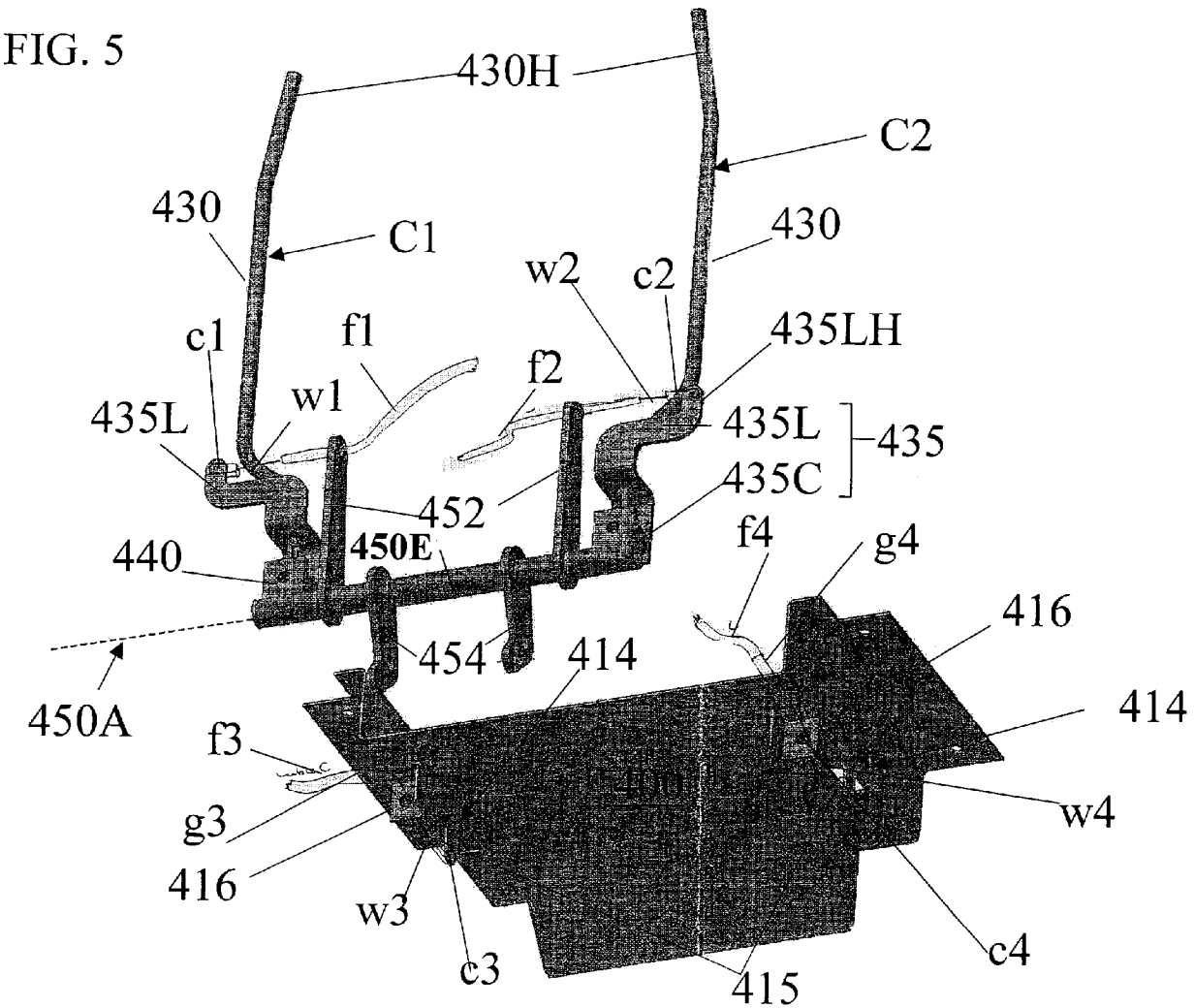
FIG. 5 is a rear bottom perspective view of the control mechanism components shown in FIG. 4.

Preferred Control Structures:

In some preferred embodiments of the invention, control structures for a vehicle can include at least some of the features depicted in FIGS. 4–5. In the most preferred embodiments, the control structures enable a multitude of control configurations. For example, in the most preferred embodiments, a multitude of configurations can be established between a) a plurality of control elements and b) a plurality of vehicle functions that can be controlled via the control elements. In the most preferred embodiments, the plurality of control elements include at least four control elements. In the most preferred embodiments, the plurality of vehicle functions include at least four vehicle functions. However, less preferred embodiments could potentially include less control elements and/or less vehicle functions depending on circumstances. Preferably, the control structures are configured such that each of a plurality of the control elements can be readily used for control of each of a plurality of the vehicle functions. For example, in some preferred embodiments, the vehicle includes at least four control elements C1, C2, C3, C4 and at least four vehicle functions F1, F2, F3, F4, where each control element can be reconfigured to control each function, whereby sixteen different control configurations can be achieved, such as shown by way of example in Table 1 below.

TABLE 1

Illustrative Control Configuration Chart

| Function | Control C1 | C2 | C3 | C4 |
|---|---|---|---|---|
| F1 | C1/F1 | C2/F1 | C3/F1 | C4/F1 |
| F2 | C1/F2 | C2/F2 | C3/F2 | C4/F2 |
| F3 | C1/F3 | C2/F3 | C3/F3 | C4/F3 |
| F4 | C1/F4 | C2/F4 | C3/F4 | C4/F4 |

Among other things, the preferred embodiments of the invention provide a vehicle control arrangement having high adaptability and/or configurability so as to enable the vehicle to be adapted and/or configured based on circumstances. In some examples, a vehicle manufacturer can readily create vehicles having various configurations based on circumstances. In some examples, a manufacturer can create vehicles having particular configurations based on the needs of one or more particular end user(s). In some examples, a vehicle can be reconfigured by an end user so as to accommodate the end user's needs, such as, for example, to reconfigure the control configuration as desired. For example, in some embodiments, an end user can have the vehicle reconfigured to accommodate new utility mechanisms, such as, e.g., new utility mechanisms supported on an extendable boom. For example, various utility mechanisms can have different control mechanisms and/or control needs. In this manner, the vehicle could be readily adapted to provide control configurations as needed or as desired based on circumstances. Additionally, in some preferred embodiments, the system can be relatively quickly reconfigured without substantial difficulties by an operator.

In some preferred embodiments, the control elements (e.g., C1, C2, C3, C4) can include a plurality (such as, e.g., two in some preferred embodiments) of hand-operated controls and/or a plurality (such as, e.g., two in some preferred embodiments) of foot-operated controls. In some embodiments, the hand-operated controls include two control arms and the foot-operated controls include two control pedals. Preferably, each of the control elements includes similar attachment mechanisms that can be reattached to different function drive elements (such as, e.g., cables or the like) as needed. For example, in the most preferred embodiments described herein, the control arms and the control pedals include similar lever arms with similar cable attachment mechanism geometries.

In some preferred embodiments, the configurable control elements include a plurality of hand-operated controls which move in a direction parallel to an operator's shoulders when seated on the vehicle (e.g., move in a side-to-side direction across the vehicle) and/or a plurality of foot-operated controls which move in a direction substantially perpendicular to an operator's shoulders when seated on the vehicle (e.g., move in a fore-to-aft direction of the vehicle).

With reference to FIG. 4, in some preferred embodiments, a plurality of control elements C1–C4 are mounted to a vehicle (such as, e.g., vehicle 100 discussed above). In some illustrative embodiments, the control elements can be mounted to a vehicle body (such as, e.g., vehicle body 125 discussed above) below an operator cab. In that regard, for example, a plurality of control arms C1 and C2 can be mounted to the vehicle body so as to extend upward from the vehicle body and into the operator cab (such as, e.g., through one or more opening(s) in a floor or bottom of the operator cab). As another example, a plurality of control pedals C3 and C4 can be mounted to the vehicle body so as to be accessible from within the operator cab (such as, e.g., through one or more opening(s) in a floor or bottom of the operator cab).

In some embodiments, where control pedals are included, structure like that shown in FIGS. 4–5 can be employed. In that regard, the control pedals C3 and C4 can be mounted upon a platform 400. The platform 400 can include, for example, lateral flanges 410 and 420 that rest upon sides of the vehicle body (such as, for example, upon side-beams 125S shown in FIG. 1(A)). The flanges 410 and 420 can, in some cases, be attached to the vehicle body via bolts extending through holes 411 and into the vehicle body (such as, e.g., into the side-beams 125S). In preferred embodiments, the platform is mounted at a front end of the vehicle (e.g., such that a side of the platform is at or proximate a front side of the vehicle body).

As shown, the control pedals C3 and C4 are preferably pivotally supported upon the platform 400. For example, two lateral support flanges 412 can be fixed to the platform 400 and a pivot shaft 413 can extend through the flanges 412 and through depending side-walls of the respective pedals C3 and C4 so as to pivotally support the pedals. Preferably, the pedals C3 and C4 are biased to a particular position, such as, e.g., via a spring, another resilient member or the like. As shown in FIG. 5, the platform 400 preferably includes through-holes 414 beneath each pedal C3 and C4. The through-holes are preferably sized to receive depending lever arms 415 that extend downward through the through-holes. The lever arms 415 are preferably fixed to respective pedals C3 and C4 so as to move therewith. As a result, movement of the pedals will result in fore-to-aft movement of the lever arms 415 beneath the platform 400. Preferably, the underside of the platform also includes cable attachment flanges 416 fixed thereto. The attachment flanges 416 preferably include through-holes that face in a direction towards respective lever arms 415, as shown, and are preferably aligned with a plane along which the respective lever arms move. Preferably, the lever arms 415 have a generally vertical height that is substantially longer than their width in a fore-to-aft direction and have a width in the fore-to-aft direction that is substantially wider than their width in a side-to-side direction. In some embodiments, the lever arms can include attachment holes proximate their distal ends that are generally aligned with the through-holes in the flanges 416 but, preferably, that are generally perpendicular thereto (as shown).

Where control arms are included, in some embodiments, structure like that shown in FIGS. 4–5 can also be employed. In that regard, the control arms C1 and C2 are preferably mounted upon the vehicle body. For example, the control arms can include elongated arms 430. The elongated arms can include upper ends 430H that serve as control handles that are manually gasped by a vehicle operator and lower ends that are fixedly attached to a control arm support bracket 435. In the illustrated embodiments, the bracket 435 includes a cylinder 435C to which the arm 430 is fixedly attached (such as, e.g., by welding or the like). In addition, the bracket 435 can also include a lever arm 435L that is also fixedly attached thereto (such as, e.g., by welding or the like). In some embodiments, the cylinder 435C can be rotatably supported so as to rotate around a axis 435A of a shaft (not shown) that is fixed to a support member 440 and that extends inside the cylinder 435C. The support member 440 can be fixedly attached to a shaft 450. Preferably, the shaft 450 includes an upwardly extending attachment flange 452. Each attachment flange 452 preferably includes a through-hole that faces in a direction towards a respective lever arm (as shown) and is preferably aligned with a plane along which the respective lever arm moves (e.g., about the axis 435A). Preferably, the lever arms 435L have a width in a fore-to-aft direction that is substantially narrower than their width in a side-to-side direction. In some embodiments, the lever arms can include attachment holes 435LH proximate their distal ends that are generally aligned with the through-holes in the flanges 452 but, preferably, that are generally perpendicular thereto (as shown).

In some embodiments, the shaft(s) 450 can be fixedly attached to the vehicle body so as to remain fixed in relation to the vehicle body. In such embodiments, substantially the only motion of the control arms C1 and C2 would preferably be resultant from movement of the control arms about the axis 435A. In some other embodiments, at least one of the control shaft(s) 450 can be rotatably supported on said vehicle body so as to rotate about an axis 450A. For example, a support shaft (not shown) can pass through the center of the shaft(s) 450 and be fixedly attached to left and right lateral sides of the vehicle body, while rotatably supporting the shaft(s) 450 thereon so as to rotate about the axis 450A. In the latter case, there are preferably two shafts 450 which each have an end 450E that is adjacent an end 450E of the other shaft 450. In this manner, the two shafts 450 can preferably rotate independently about the axis 450A. As shown, each shaft 450 can also include lever arms 454 extending therefrom which can be used to control various vehicle functions as desired.

As illustrated in the embodiments shown in FIGS. 4–5, the control elements C1–C4 each preferably include similar lever arm geometries and similar attachment mechanism geometries. In this manner, the control elements C1–C4 can be readily connected to desired drive elements (such as, e.g., cables or the like) for different functions (such as, e.g., functions F1–F4) without modification of drive elements and/or control elements.

As shown, in some illustrative embodiments, the drive elements can include drive cables f1–f4. In some illustrative embodiments, the drive cables f1–f4 can include internal metal or the like cables or wires w1–w4. In some embodiments, the cables or wires w1–w4 can be guided within guide conduits or shrouds g1–g4. In some embodiments, the wires w1–w4 can be detachably connected to the respective lever arms 415 and/or 435L via connectors c1–c4. In illustrative embodiments, the connectors c1–c4 can include clips, clamps, locks, nuts, brackets, bolts and/or any other appropriate connector. In some embodiments, as shown, the connectors include generally U-shape brackets that are attached to a respective wire w1–w4 at a base thereof and with a pin that extends between legs of the U-shape bracket and through a through-hole in the respective lever for attachment thereto. In some preferred embodiments, guide conduits or shrouds g1–g4 can be supported via the attachment flanges 416 or 452, respectively (such as, e.g., being clamped thereto or otherwise supported and/or fixed thereto).

In some preferred embodiments, the connections between the function drive elements and the control elements are located proximate one another such that drive elements can readily be repositioned with respect to the control elements. For example, in the illustrated embodiments, cable-type function drive elements can be readily repositioned at other locations without providing additional cable or otherwise adapting the device in preferred embodiments. Additionally, in preferred embodiments, the connections between the function drive elements and the control elements are readily made accessible for reconfiguration when desired. In this regard, for example, in some embodiments, the cab can be tilted forward, a boom structure can be raised, a top cover can be removed and/or a rear door can be opened (such as, e.g., as shown FIG. 3) to facilitate access to these connections for reconfiguration.

In some examples, an operator's seat can be fixedly attached to the cab structure so as to pivotally move therewith (such as, e.g., as shown in FIG. 3). In normal use during operation of the vehicle, when the cab is in a down position, such as shown in FIGS. 1(A) and 2(A), the seat can be located above or proximate to a point above the shaft(s) 450. Then, upon pivoting the cab forward, the connections can be relatively easily accessed for maintenance, service, adaptability and/or configurability.

In the illustrative embodiments shown in FIGS. 1(A)–5, the functions F1–F4 can include, for example, one or more, preferably all, of the following functions:

- F1: Lifting and/or lowering of a boom (such as, e.g., by operating hydraulic boom cylinders as shown);
- F2: Roll-out and/or roll-in of a bucket (such as, e.g., by operating hydraulic bucket cylinders as shown);
- F3: Increase and/or decrease of an engine throttle (such as, e.g., by controlling a throttle valve to increase fuel introduction rate and/or to decrease fuel introduction rate); and
- F4: Control of auxiliary devices, such as auxiliary attachments, other utility mechanisms and/or other components (such as, e.g., depending on circumstances and/or needs).

It should be appreciated that various other embodiments of the invention can involve one or more of the above functions and/or various other functions as would be known in the art and/or as would depend on the circumstances at hand. Among other things, by having various vehicle functions driven by similarly configured drive mechanisms (e.g., similar cable structure) and by similarly configured control elements (e.g., similar lever arm structure), the preferred embodiments can have a multitude of control-to-function configurations. In various embodiments, the "functions" that can be controlled via the control elements are preferably performed by powered devices, such as, e.g., devices powered by motors, by drives (such as, e.g., a hydraulic or other drives), by electrical sources, by manual power and/or by other power sources. Preferably, the control elements can be used to control the operation of or the use of such powered devices, such as via, e.g., a variable control, an ON/OFF control and/or another form of control. In some embodiments, the control elements can be used to control the position of devices, the rate of operation of devices, the extent of operation of devices and/or other required control(s) depending on circumstances.

Broad Scope of the Invention:

While illustrative embodiments of the invention have been described herein, the present invention is not limited to the various preferred embodiments described herein, but includes any and all embodiments having modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." Means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited.

What is claimed is:

1. A skid steer utility vehicle having an extendable boom, comprising:

a) a vehicle body;

b) an engine supported by said vehicle body;

c) an extendable boom supported by said body;

d) a utility mechanism supported by said boom;

e) a plurality of controlled devices, each of said controlled devices affecting a respective vehicle function, and each of said controlled devices being driven by a similarly configured drive mechanism;

f) a plurality of user operated control elements, each of said user operator control elements having a similarly configured control attachment mechanism; and g) each said control attachment mechanism being connectable with each said drive attachment mechanism to provide a multitude of control-to-function configurations, wherein said control elements include a plurality of hand controls and a plurality of foot controls and said multitude of control-to-function configurations includes at least sixteen selectable configurations.

2. The utility vehicle of claim 1, wherein said controlled devices include a) a throttle for said engine, b) a drive mechanism for said boom, and c) a drive mechanism for said utility mechanism.

3. The utility vehicle of claim 1, wherein said control elements include a plurality of hand controls.

4. The utility vehicle of claim 1, wherein said control elements include a plurality of foot controls.

5. The utility vehicle of claim 1, wherein said controlled devices include a) a throttle for said engine, b) a drive mechanism for said boom, and c) a drive mechanism for said utility mechanism.

6. The utility vehicle of claim 1, wherein said controlled devices include a) a throttle for said engine, b) a drive mechanism for said boom, c) an auxiliary attachment control device and d) a bucket moving device.

7. The utility vehicle of claim 1, wherein there are at least four control elements and controlled devices performing at least four controlled functions.

8. The utility vehicle of claim 1, wherein said control elements include a plurality of hand operated control arms and a plurality of foot operated control pedals.

9. The utility vehicle of claim 8, wherein said hand operated control arms are each pivotable around an axis substantially parallel to a fore-to-aft direction of the vehicle and said foot operated control pedals are each pivotable around an axis substantially parallel to a side-to-side direction of the vehicle.

10. The utility vehicle of claim 1, wherein each said control attachment mechanism includes a control lever and each said drive attachment mechanism includes a cable.

11. A utility vehicle having at least one utility mechanism, comprising:

a) a vehicle body;

b) an engine supported by said vehicle body;

c) at least one utility mechanism supported by said vehicle body;

d) at least four controlled devices, each of said controlled devices affecting a respective vehicle function, and each of said controlled devices being driven by a similarly configured drive mechanism;

e) at least four user operated control elements, each of said user operator control elements having a similarly configured control attachment mechanism; and f) each said control attachment mechanism being connectable with each said drive attachment mechanism to provide at least sixteen control-to-function configurations.

12. The utility vehicle of claim 11, wherein said controlled devices include a) a throttle for said engine, b) a drive mechanism for an extendable boom, and c) a drive mechanism for said at least one utility mechanism.

13. The utility vehicle of claim 11, wherein said control elements include a plurality of hand controls.

14. The utility vehicle of claim 11, wherein said control elements include a plurality of foot controls.

15. The utility vehicle of claim 11, wherein said control elements include a plurality of hand controls and a plurality of foot controls.

16. The utility vehicle of claim 15, wherein said controlled devices include a) a throttle for said engine, b) a drive mechanism for a utility boom, and c) a drive mechanism for said at least one utility mechanism.

17. The utility vehicle of claim 15, wherein said controlled devices include a) a throttle for said engine, b) a drive mechanism for a utility boom, c) an auxiliary attachment control device and d) a bucket moving device.

18. The utility vehicle of claim 11, wherein said control elements include a plurality of hand operated control arms and a plurality of foot operated control pedals.

19. The utility vehicle of claim 18, wherein said hand operated control arms are each pivotable around an axis substantially parallel to a fore-to-aft direction of the vehicle and said foot operated control pedals are each pivotable around an axis substantially parallel to a side-to-side direction of the vehicle.

20. The utility vehicle of claim 11, wherein each said control attachment mechanism includes a control lever and each said drive attachment mechanism includes a cable.

21. The utility vehicle of claim 11, wherein said utility vehicle is a skid steer vehicle.

22. The utility vehicle of claim 21, wherein said skid steer vehicle includes an extendable utility boom.

* * * * *